US010786923B2

(12) United States Patent
Corcoran

(10) Patent No.: US 10,786,923 B2
(45) Date of Patent: Sep. 29, 2020

(54) MAGNETIC CUTTING PLATFORM FOR USE WITH A DIE CUTTING MACHINE

(71) Applicant: Kevin L. Corcoran, Mission Viejo, CA (US)

(72) Inventor: Kevin L. Corcoran, Mission Viejo, CA (US)

( * ) Notice: Subject to any disclaimer, the term of this patent is extended or adjusted under 35 U.S.C. 154(b) by 204 days.

(21) Appl. No.: 14/154,340

(22) Filed: Jan. 14, 2014

(65) Prior Publication Data

US 2015/0197029 A1 Jul. 16, 2015

(51) Int. Cl.

| | |
|---|---|
| ***B26F 1/38*** | (2006.01) |
| ***B26F 1/42*** | (2006.01) |
| ***B26F 1/44*** | (2006.01) |
| ***B26F 1/40*** | (2006.01) |

(52) U.S. Cl.

CPC ..... *B26F 1/3806* (2013.01); *B26F 1/42* (2013.01); *B26F 1/44* (2013.01); *B26F 1/38* (2013.01); *B26F 1/40* (2013.01); *Y10T 83/75* (2015.04)

(58) Field of Classification Search

CPC .. B26F 1/32; B26F 1/38; B26F 1/3806; B26F 1/00; B26F 1/40; B26F 1/42; B26F 1/44; Y10T 83/9309; Y10T 83/9312

USPC ..... 83/658

See application file for complete search history.

(56) References Cited

U.S. PATENT DOCUMENTS 3,062,083 A * 11/1962 Strnad ..... B21D 37/04 76/107.8
3,135,397 A * 6/1964 Kull ..... B21J 13/085 100/918
3,199,390 A * 8/1965 Arnould ..... B26D 7/2628 100/160
4,092,890 A * 6/1978 Bousquet ..... B26F 1/42 83/284
4,476,762 A * 10/1984 Anderson, III ..... B26D 7/2614 279/128
4,643,062 A * 2/1987 Highfield ..... B26F 1/384 83/284
5,004,468 A * 4/1991 Atkinson ..... A61B 17/322 606/132
5,255,587 A * 10/1993 Eichenberg ..... B26D 5/10 83/628
5,647,260 A * 7/1997 Nabity ..... B26F 1/42 83/522.12
5,778,748 A * 7/1998 Beijen ..... B26D 5/08 83/529

(Continued)

*Primary Examiner* — Andrea L Wellington
*Assistant Examiner* — Richard D Crosby, Jr.
(74) *Attorney, Agent, or Firm* — Morland C. Fischer

(57) ABSTRACT

A magnetic cutting platform for use with a (e.g., portable hand operated) die cutting machine that is capable of generating a cutting force to be applied to the cutting platform so that designs can be accurately cut from a sheet material. The magnetic cutting platform includes a (e.g., steel) cutting die having a downwardly facing cutting edge which is aligned with the design of the sheet material. A magnetic base of the cutting platform holds the cutting die in place on the sheet material and prevents the cutting edge of the die from moving out of alignment with the design. The cutting die and sheet material are sandwiched and compressed between upper and lower cutting pads to push the cutting edge of the cutting die downwardly through the sheet material to cut the design therefrom.

11 Claims, 3 Drawing Sheets

(56) References Cited

U.S. PATENT DOCUMENTS 6,619,195 B2 * 9/2003 Corcoran ..... B26D 5/10 100/224
6,945,166 B2 * 9/2005 Corcoran ..... B26D 5/16 100/229 R
7,011,009 B1 * 3/2006 Tomich ..... B26F 1/02 29/465
7,083,559 B2 * 8/2006 Castello ..... D21H 21/40 156/227
7,127,987 B2 * 10/2006 Criss ..... B26F 1/44 101/28
7,293,501 B2 * 11/2007 Lee ..... B44C 1/24 100/176
7,329,208 B2 * 2/2008 Yeh ..... A61H 7/001 482/54
7,335,009 B2 * 2/2008 Lee ..... B26F 1/42 100/176
7,546,800 B2 * 6/2009 Caron ..... B26F 1/42 101/16
7,743,700 B2 * 6/2010 Ayala ..... B26F 1/42 100/176
7,856,912 B2 * 12/2010 Corcoran ..... B26D 5/10 403/321
8,950,320 B2 * 2/2015 Nabity ..... B26F 1/384 100/173
9,956,700 B2 * 5/2018 Carey ..... B26D 5/10
2004/0112196 A1 * 6/2004 Corcoran ..... B26D 5/10 83/686
2004/0118304 A1 * 6/2004 Corcoran ..... B31F 1/07 101/28
2005/0034785 A1 * 2/2005 Lovchik ..... B27C 9/00 144/356
2005/0061168 A1 * 3/2005 Corcoran ..... B26D 7/20 100/219
2005/0235796 A1 * 10/2005 Willits ..... B26F 1/44 83/623
2005/0253324 A1 * 11/2005 Corcoran ..... B26F 1/42 271/15
2005/0268761 A1 * 12/2005 Corcoran ..... B26D 7/2614 83/13
2006/0266193 A1 * 11/2006 Corcoran ..... B26D 7/2628 83/669
2009/0013830 A1 * 1/2009 Pfaff, Jr. ..... B23P 15/406 76/107.8
2011/0252939 A1 * 10/2011 Nabity ..... B26F 1/384 83/859
2011/0277606 A1 * 11/2011 Park ..... B26D 7/2614 83/100
2011/0303068 A1 * 12/2011 Exley ..... B26F 1/04 83/698.21
2013/0025424 A1 * 1/2013 Block ..... B26F 1/44 83/111
2014/0113073 A1 * 4/2014 Peng ..... B41M 5/0256 427/248.1
2014/0165811 A1 * 6/2014 Lee ..... B26D 5/08 83/633
2014/0260851 A1 * 9/2014 Beaudry ..... B26D 7/2614 83/56
2014/0283697 A1 * 9/2014 Lu ..... B31F 1/07 101/23

* cited by examiner

MAGNETIC CUTTING PLATFORM FOR USE WITH A DIE CUTTING MACHINE

BACKGROUND OF THE INVENTION

1. Field of the Invention

This invention relates to a magnetic cutting platform to receive a compressive cutting force generated by a die cutting machine so that designs can be accurately cut from a sheet material. The magnetic cutting platform has a magnetic base to hold the position of a cutting die on the sheet material and thereby prevent the position of a downwardly facing cutting edge of the die from changing relative to the design to be cut from the sheet.

2. Background Art

Die cutting machines have been regularly used by schools, libraries, and similar institutions when it is desirable to cut various designs, such as letters, shapes, and the like from sheet material for the purpose of making a sign, banner or a display to attract the attention of passersby. A user manipulates a handle or a similar pushing surface of the machine to cause a cutting force to be generated. The cutting force is transferred to a die cutting assembly which carries the sheet material to be cut. The die cutting assembly includes a cutting die which cuts the design from the sheet material.

On occasion, the position of the cutting die is susceptible to change relative to the design to be cut out of the sheet material. For example, handling the die cutting assembly prior to and during the application of the cutting force from the die cutting machine to the cutting die has been known to cause a displacement of the cutting die from its initial position in registration with the design to be cut from the sheet material. Moreover, in many cases, the cutting die lies below the sheet material and the cutting edge thereof faces upwardly, whereby it is often difficult to accurately position and hold the cutting edge in alignment with the design to be cut. As a consequence of the foregoing, the shape that is ultimately cut from the sheet material is offset and shifted with respect to the design that is printed on the sheet material and intended to be cut therefrom. Thus, the accuracy and aesthetic appearance of the die cut are negatively impacted.

SUMMARY OF THE INVENTION

In general terms, a magnetic cutting platform is disclosed which includes a (e.g., steel) cutting die by which to accurately cut out designs that are printed on a sheet material. The magnetic cutting platform is adapted to be used in combination with, for example, a portable hand-operated die cutting machine that is capable of generating a compressive cutting force by which to press a cutting edge of the cutting die through the sheet material to cut out the design with which the die is aligned.

The magnetic cutting platform includes a magnetic base in which an array of magnets is embedded. A cover sheet is attached (e.g., adhesively bonded) over the top of the magnetic base to prevent the magnets from inadvertently falling out. A lower cutting pad is laid across the cover sheet at the top of the magnetic base, and the sheet bearing the design to be cut is laid on top of the lower cutting pad. The cutting die has a cutting edge facing downwardly therefrom. The cutting die is positioned on the sheet material such that the downwardly facing cutting edge is aligned with the design to be cut. An upper cutting pad is laid over the cutting die to complete the assembly of the magnetic cutting platform so that the cutting die and the sheet material are sandwiched between the upper and lower cutting pads.

The assembled magnetic cutting platform is laid upon and advanced along a cutting table of the die cutting machine in response to a rotation of a handle of the cutting machine. A compressive cutting force generated by the die cutting machine is transmitted to the cutting die by way of the upper cutting pad. Thus, the downwardly facing cutting edge of the die is pushed through the sheet material to cut the design therefrom. The array of magnets embedded in the magnetic base holds the cutting die in place on the sheet material so that the cutting edge thereof remains in accurate alignment with the design throughout the cutting process. The lower cutting pad of the magnetic cutting platform which lies between the cutting die and the magnetic base prevents damage to the magnetic base when the cutting edge of the die cuts through the sheet material.

DESCRIPTION OF THE PREFERRED EMBODIMENT

Figure 1:
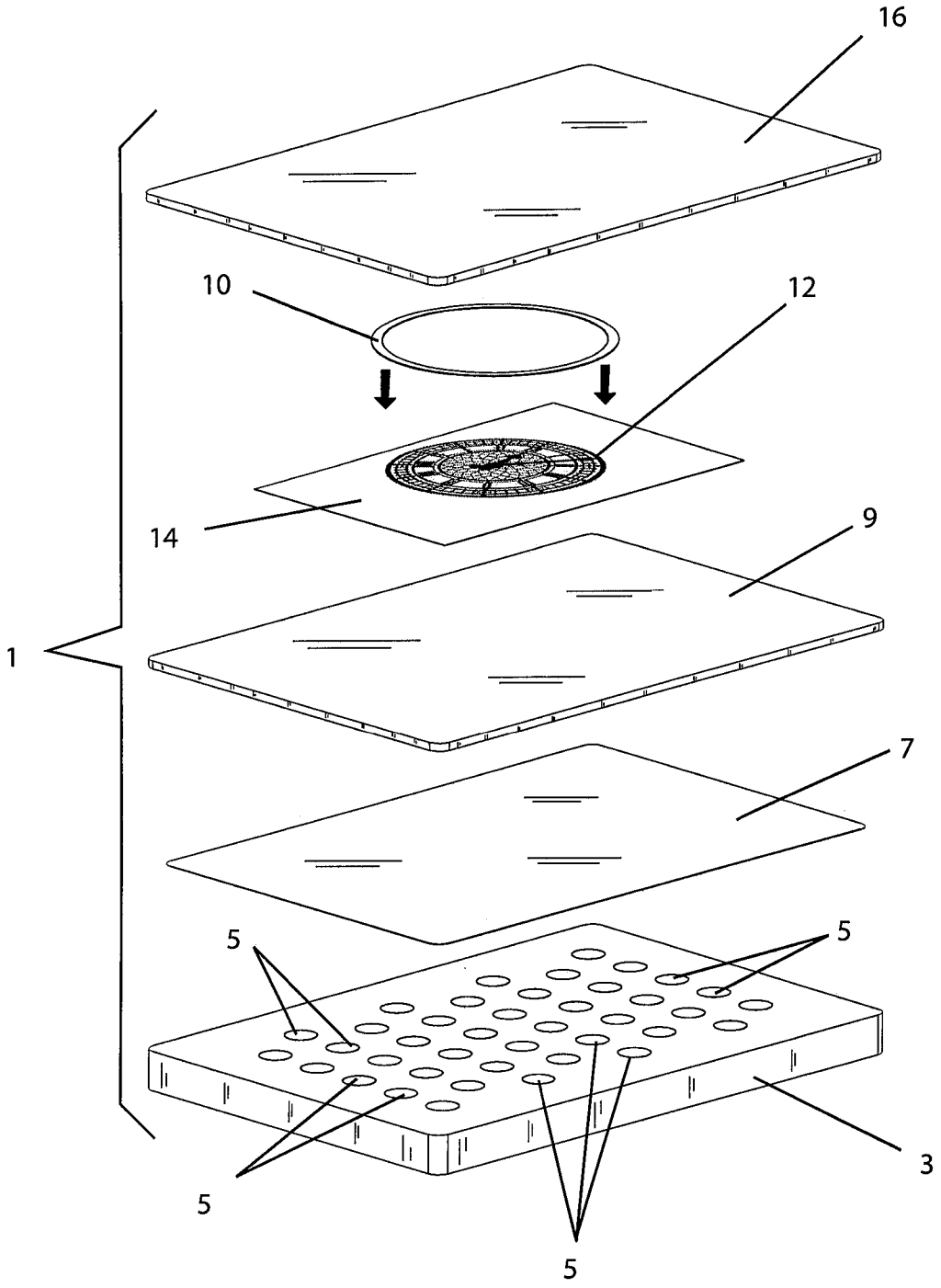
FIG. 1 is an exploded perspective view of a magnetic cutting platform according to a preferred embodiment which includes a cutting die by which to accurately cut a design out of a sheet material carried by the cutting platform.
Figure 2:
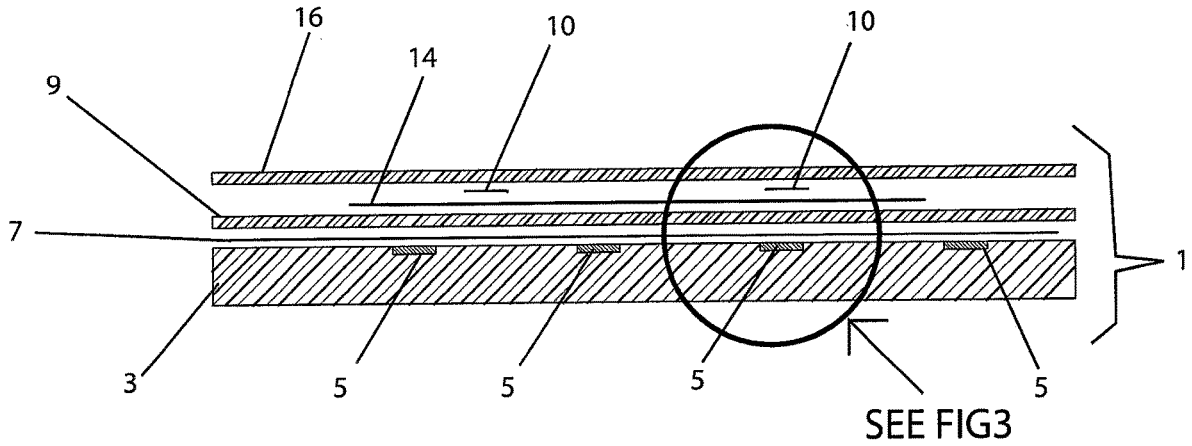
FIG. 2 is an exploded side view of the magnetic cutting platform shown in FIG. 1.
Figure 3:
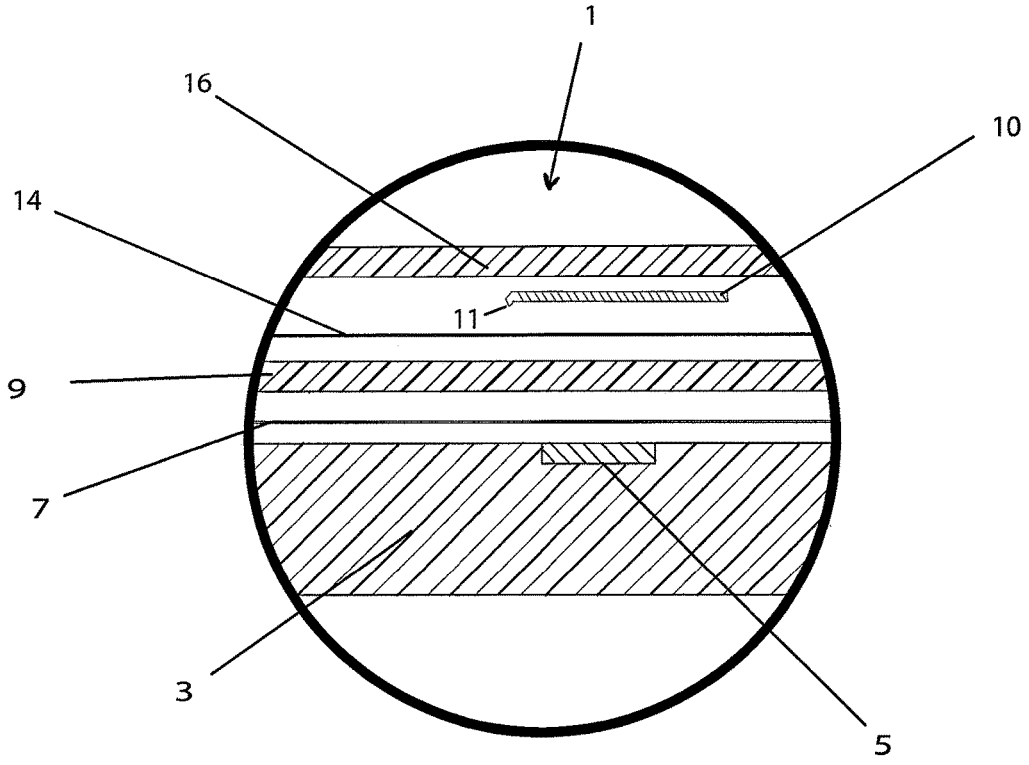
FIG. 3 is an enlarged detail of the magnetic cutting platform shown in FIG. 3.

A preferred embodiment for a magnetic cutting platform 1 which has particular application for use with a hand-operated die cutting machine (designated 20 in FIG. 4) is described while referring currently to FIGS. 1-3 of the drawings. The cutting platform 1 includes a magnetic base 3. The magnetic base 3 is preferably manufactured from a non-magnetic material such as, for example, polypropylene or ABS plastic. An array of magnets 5 are embedded within the magnetic base 3 so as to lie flush with the top thereof. The flush-disposed magnets 5 advantageously ensure that the top of the base 3 will be a completely flat surface. The magnets 5 can be manufactured from a rare earth magnetic material or any other suitable magnetic material. Each magnet 5 preferably has a disk shape with a thickness of about 2 mm and a diameter of about 10 mm. A total of forty magnets 5 (as shown in FIG. 1) are uniformly spaced from one another across the top of the magnetic base 3. However, the number, dimensions and shape of the magnets 5 in the array thereof should not be taken as a limitation of this invention.

To prevent the magnets 5 from inadvertently falling out of the magnetic base 3 of the magnetic cutting platform 1, a thin non-magnetic cover sheet 7 is placed across the top of base 3. The cover sheet 7 is preferably adhesively bonded to the magnetic base 3 to lie over top the array of magnets 5 that are recessed therewithin. By way of example only, the cover sheet 7 may be made of paper, or the like.

A wear-resistant, lower cutting pad 9 is laid over the cover sheet 7 that is attached across the magnetic base 3 over top the magnets 5. The lower cutting pad 9 is manufactured, for example, from polycarbonate or any other suitable relatively hard material that is capable of withstanding being penetrated by a cutting edge of a soon-to-be described cutting die 10 to be positioned above cutting pad 9. The cutting pad 9 is ideally about 3 mm thick in order to create a protective intermediate surface between the cutting die 10 and the magnetic base 3 to prevent scarring of and damage to the magnetic base 3 when the magnetic cutting platform 1 is utilized within a die cutting machine (designated 20 in FIG. 4). In this case and as was earlier explained, each magnet from the array thereof has a thickness of about 2 mm in order to generate sufficient magnetic force through the lower cutting pad 9 for preventing the cutting die 10 from shifting as will soon be described.

The aforementioned cutting die 10 is used to cut any one of a variety of designs 12 from a sheet material 14 when the cutting die is forced downwardly against the sheet material. By way of example, the sheet material 14 may be manufactured from paper, plastic, leather, etc., and the design 12 to be cut therefrom may be printed on the sheet material so as to have a shape and/or size that suits the needs of a user of the cutting machine. The cutting die 10 has a cutting edge 11 (best shown in FIG. 3) facing downwardly from the bottom thereof which is adapted to cut through the sheet material 14 in response to a cutting force applied to the die 10 by the die cutting machine. The cutting die 10 is manufactured from a magnetic material (e.g., steel) for a purpose that will soon be described.

As is best shown in FIGS. 2 and 3, the sheet material 14 bearing the design 12 to be cut therefrom is laid upon the cutting pad 9. The cutting die 10 is then laid over the sheet material 14 such that the cutting blade 11 of cutting die 10 surrounds the periphery of the design 12. It may therefore be appreciated that the shape and size of the cutting die 10 conform to the shape and size of the design 12 to be cut from the sheet material 14 such that the die is aligned in registration with the design.

The magnetic cutting platform 1 is completed when an upper cutting pad 16 is laid over top the cutting die 10. As is also best shown in FIGS. 2 and 3, with the cutting platform 1 assembled and ready to be used with the die cutting machine 20, the sheet material 14 and the cutting die 10 laying thereon are sandwiched between the lower and upper cutting pads 9 and 16, such that a compressive cutting force generated by the cutting machine is transmitted to the cutting die 10 by way of upper cutting pad 16. Like the lower cutting pad 9, the upper cutting pad 16 is manufactured from a suitable relatively hard wear-resistant material, such as polycarbonate, or the like.

Figure 4:
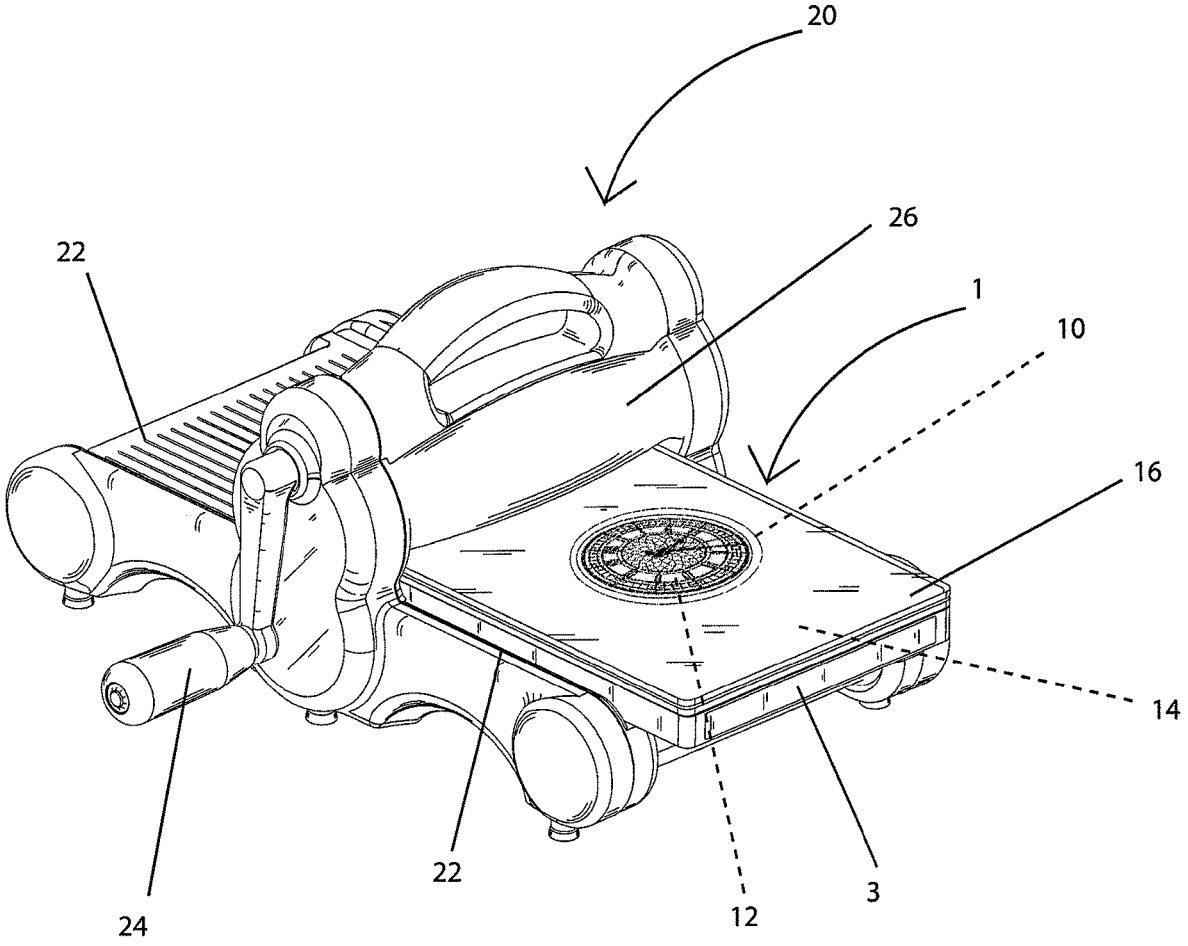
FIG. 4 shows an example of a hand-operated die cutting machine adapted to generate a compressive cutting force against the cutting die of the magnetic cutting platform to cut the design from the sheet material.

Turning now to FIG. 4 of the drawings, there is shown a (e.g., portable hand-operated) die cutting machine 20 with which the magnetic cutting platform shown in FIGS. 1-3 can be used to cut the design 12 from the sheet material 14. That is, the die cutting machine 20 is adapted to apply a compressive cutting force to the cutting die 10 to force the cutting edge 11 of the die through sheet material 14. However, it is to be expressly understood that the particular die cutting machine shown in FIG. 4 is not to be considered a limitation of this invention.

By way of example only, one suitable hand-operated die cutting machine that is suitable to accept the magnetic cutting platform 1 is that known commercially as the BIG KICK manufactured by Ellison Educational Equipment, Inc. of Lake Forest, Calif. Reference can be made in this regard to U.S. Design Pat. No. D607,910 issued Jan. 12, 2010 for an illustration of such a die-cutting machine.

In this example, with the cutting die 10 and the sheet material 14 sandwiched between the lower and upper cutting pads 9 and 16, the magnetic cutting platform 1 is laid on one side of a cutting table 22 of the cutting machine 20. A rotational force applied to a handle 24 of the cutting machine 20 causes the cutting platform 1 to be advanced linearly along the cutting table 22 by means of a roller (not shown) that is housed inside a cover 26 of the cutting machine. As the cutting platform 1 is moved below the cover 26, a cutting force is applied by the roller to the upper cutting pad 16. However, other cutting machines, such as those which have a flat cutting force-generating plate, can be used in substitution of the cutting machine 20 shown in FIG. 4.

Accordingly, the cutting die 10 and the sheet material 14 are compressed against the cutting table 22 of the die cutting machine 20 and between the lower and upper cutting pads 9 and 16 of the cutting platform 1. The cutting force being applied from machine 20 to the upper cutting pad 16 presses the cutting edge 11 of the cutting die 10 downwardly through the sheet material 14, whereby to cut the design therefrom. The handle 24 of machine 20 is rotated until the magnetic cutting platform 1 is rolled past the cover 26 to the opposite side of the cutting table 22. The magnetic cutting platform 1 can now be removed from the die cutting machine 20 and disassembled to enable the user to gain access to the design 12 that has just been cut out of the sheet material 14.

By virtue of the magnetic cutting platform 1 shown in FIGS. 1-3, precise designs can be cut from the sheet material 14 as the cutting platform is advanced along the cutting table 22 of the die cutting machine 20. More particularly, the array of magnets 5 embedded within the base 3 of cutting platform 1 holds the (e.g., steel) cutting die 10 in place on the sheet material 14 and prevents the downwardly facing cutting edge 11 of die 10 from moving out of its alignment with the design 12 on the sheet material 14. To this end, and especially in the case where small cutting dies are employed, the magnets 5 embedded within the base 3 should ideally be spaced from one another so that there are at least two magnets located below the die to hold the die in place and prevent it from shifting over the sheet material.

Because the cutting edge 11 faces downwardly from the cutting die 10, the die can be initially positioned on top of the sheet material 14 so as to surround and accurately define the design 12 to be cut. The magnets 5 hold the cutting die 10 in place and prevent the cutting edge 11 from moving when the magnetic cutting platform 1 is assembled with the cutting die 10 and sheet material 14 sandwiched between the lower and upper cutting pads 16 and 9. The magnets 5 also hold the cutting die 10 in place when the magnetic cutting platform 1 is laid on and moved along the cutting table 22 of the die cutting machine 1 to receive the compressive cutting force generated by the machine 1 against the upper cutting pad 16.

What is even more, and as has been explained above, the lower cutting pad 9 upon which the sheet material 14 is laid prevents scarring and damage to the magnetic base 3 and the magnets 5 thereof as a consequence of the downwardly facing cutting edge 11 of the cutting die 10 cutting through the sheet material 14. This advantage avoids having to make frequent replacements of the magnetic base 3. The upper cutting pad 12 which lies over top the cutting die 10 enables the compressive cutting force generated by the die cutting machine 20 to be uniformly distributed to die 10 to push the cutting edge 11 thereof cleanly through the sheet material 14 to cut the design 12 therefrom.

The invention claimed is:

1. A combination including a magnetic cutting platform and a sheet material for use with a machine that is adapted to generate a cutting force against the sheet material, said sheet material having a top and a bottom with the top of the sheet material bearing a design that is printed thereon to be cut out therefrom, said magnetic cutting platform adapted to be moved through the machine in response to a pushing force applied thereto by said machine and comprising:

a magnetic base containing at least one magnet lying below the bottom of said sheet material;

a cutting die having a cutting edge with a shape that conforms to the shape of the design that is printed on and is to be cut from the sheet material, said sheet material lying between said cutting die and said magnetic base so that said cutting die is adjustably positioned on the top of said sheet material and the cutting edge of said die faces downwardly so as to be aligned in registration with the periphery of the design that is printed on the top of and is to be cut from said sheet material; and a first cutting pad positioned above said cutting die at which to be engaged by said machine so as to receive the pushing force applied to said magnetic cutting platform by said machine and to receive the cutting force generated by the machine when said magnetic cutting platform and said sheet material are used with said machine, said cutting force being transferred from said first cutting pad to said cutting die to push the cutting edge of said die downwardly towards said magnetic base and through said sheet material to thereby cut the design therefrom, wherein the at least one magnet of said magnetic base of said magnetic cutting platform is located below said cutting die to generate a magnetic force that is sufficient to hold said cutting die against flhe top of said sheet material to prevent the cutting edge of said cutting die from moving out of alignment with the periphery of the design that is printed on the top of said sheet material, such that said sheet material is located in between said cutting die and said magnetic base of said magnetic cutting platform, and the first cutting pad, the cutting die, the sheet material, and the magnetic base of said magnetic cutting platform are all moved together when the magnetic cutting platform is moved through the machine in response to the pushing force applied by the machine to the first cutting pad of said magnetic cutting platform.

2. The combination recited in claim 1, wherein said at least one magnet of the magnetic base of said magnetic cutting platform is a plurality of magnets for holding said cutting die against the top of said sheet material and preventing the cutting edge of said die from moving out of alignment with the periphery of the design that is printed on the top of said sheet material, said plurality of magnets being spaced from one another so that at least two of said plurality of magnets lie below said cutting die for holding said die in place against the top of said sheet material.

3. The combination recited in claim 2, wherein said plurality of magnets are embedded within said magnetic base of said magnetic cutting platform so as to lie flush with the top of said magnetic base.

4. The combination recited in claim 2, further comprising a cover attached to said magnetic base of said magnetic cutting platform so as to lie over the top of said plurality of magnets.

5. The combination recited in claim 2, wherein said cutting die is manufactured from a magnetic material so that said die is attracted by the at least two of said plurality of magnets of said magnetic base of said magnetic cutting platfbrm and held by said two magnets against the top of said sheet material.

6. The combination recited in claim 1, wherein said magnetic cutting platform further comprises a second cutting pad positioned between said sheet material and said magnetic base of said magnetic cutting platform, such that said cutting die and said sheet material are sandwiched between said first and said second cutting pads when said magnetic cutting platform is used with the machine and the cutting force generated by said machine is received by said first cutting pad.

7. The combination recited in claim 6, wherein said second cutting pad is manufactured from a material adapted to prevent the penetration thereof by the cutting edge of said cutting die when said cutting edge is pushed downwardly towards said magnetic base of said magnetic cutting platform and through said sheet material.

8. A combination comprising:

a die cutting machine adapted to generate a pushing force and a cutting force; and a magnetic cutting platform to be moved through said die cutting machine in response to the pushing force generated by said die cutting machine and to receive the cutting force generated thereby, said magnetic cutting platform including:

a magnetic base containing at least one magnet;

a sheet material having a top and a bottom with the top of said sheet material bearing a design to cut out, said sheet material located above said magnetic base;

a cutting die manufactured from a magnetic material and having a cutting edge which conforms to, the shape of the design to be cut out of the sheet material, said sheet material lying between said cutting die and said magnetic base and said cutting die is adjustably positioned on the top of said sheet material so that the cutting edge of said die faces downwardly so as to be aligned in registration with the periphery of the design to be cut from said sheet material; and a first cutting pad positioned above said cutting die at which to be engaged by said die cutting machine so as to receive the pushing force and the cutting force generated by the die cutting machine, said cutting force being transferred from said first cutting pad to said cutting die to push the cutting edge of said die downwardly towards said magnetic base and through said sheet material to thereby cut the design therefrom, wherein the at least one magnet of said magnetic base is located below said cutting die to generate a magnetic force that is sufficient to hold said magnetic cutting die against the top of said sheet material to prevent the cutting edge of said cutting die from moving out of alignment with the periphery of the design on the top of said sheet material, such that the first cutting pad, the magnetic base, the cutting die, and the sheet material of said cutting platform are positioned one on top of the other and all moved together through said die cutting machine in response to the pushing force generated by said die cutting machine and received by said first cutting pad of said magnetic cutting platform at the same time that the design is cm from said sheet material.

9. The combination recited in claim 8, said magnetic cutting platform further including a second cutting pad positioned between said sheet material and said magnetic base, such that said magnetic cutting die and said sheet material are sandwiched between said first and said second cutting pads when said magnetic cutting platform is used with the die cutting machine and the cutting force generated by said machine is received by the first cutting pad of said magnetic cutting platform.

10. The combination recited in claim 9, wherein the second cutting pad of said magnetic cutting platform is manufactured from a material adapted to prevent the penetration thereof by the cutting edge of said magnetic cutting die when said cutting edge is pushed downwardly towards said magnetic base and through said sheet material.

11. The combination recited in claim 9, wherein said die cutting machine is a portable hand operated machine that includes a cutting table upon which said magnetic cutting platform is laid to receive the cutting force, said die cutting machine generating said cutting force to compress said first and second cutting pads together against said cutting table with said magnetic cutting die and said sheet material being sandwiched between said first and second cutting pads.

* * * * *